US005456595A

United States Patent [19]

Henderson

[11] Patent Number: 5,456,595

[45] Date of Patent: Oct. 10, 1995

[54] DEVICE FOR PREVENTING FLAREUP IN BAROMETRIC-TYPE WICK-FED LIQUID FUEL BURNERS

[76] Inventor: Richard W. Henderson, P.O. Box 15010, Quinby, S.C. 29506

[21] Appl. No.: 247,925

[22] Filed: May 23, 1994

[51] Int. Cl.[6] ..... F23D 5/16

[52] U.S. Cl. ..... 431/2; 431/119; 431/307; 126/96; 137/405; 137/421; 141/198; 141/324; 141/364

[58] Field of Search ..... 431/298, 302–307, 431/319, 117, 118, 119, 2, 29, 344; 126/96; 137/405, 406, 420, 421; 141/198, 324, 364, 354, 353, 356, 357

[56] References Cited

U.S. PATENT DOCUMENTS

| | | | |
|---|---|---|---|
| 16,339 | 5/1926 | Daniels . | |
| 1,623,161 | 4/1927 | Buerger | 137/405 |
| 1,706,704 | 3/1929 | Phillips | 137/405 |
| 1,725,538 | 8/1929 | Remnsnider | 137/405 |
| 2,397,120 | 3/1946 | Breese et al. | 137/405 |
| 3,169,519 | 2/1965 | Aizawa . | |
| 3,501,252 | 3/1970 | Richardson . | |
| 4,363,620 | 10/1982 | Nakamura . | |
| 4,664,095 | 5/1987 | Takahashi . | |
| 4,797,088 | 1/1989 | Nakamura . | |
| 4,872,831 | 10/1989 | Fujimoto . | |
| 5,080,578 | 1/1992 | Josephs . | |
| 5,165,883 | 5/1992 | Van Bemmel . | |
| 5,338,185 | 8/1994 | Henderson et al. | 431/34 |
| 5,409,370 | 4/1995 | Henderson | 431/2 |

FOREIGN PATENT DOCUMENTS 1205018 9/1970 United Kingdom .

OTHER PUBLICATIONS

Richard W. Henderson and George A. Lightsey, "Kerosene Heater Fires: Barometric Type," *Fire Marshals Bulletin* (87–5), pp. 8–10, Nov. 1987.

Richard W. Henderson and Goerge R. Lightsey,"Kerosene Heater Fires: Barometric Type," *The National Fire and Arson Report,* vol. 6(1), pp. 2–4 (1988).

Richard W, Henderson, "Barometric Kerosene Heaters," *Fire and Arsen Investigator,* vol. 39(3), pp. 26–27 (1989).

John J. Lentini, "Gasoline and Kerosene Don't Mix–At Least, Not in Kerosene Heaters," *Fire Journal,* vol. 83 (4), pp. 13, 86 (1989) (Jul.–Aug.).

*Primary Examiner*—James C. Yeung
*Attorney, Agent, or Firm*—David Pressman

[57] ABSTRACT

A safety device for preventing uncontrolled burning in wick-fed liquid fuel burners employs an excess fuel containment compartment (24) which receives any excess fuel which might be fed to the fuel supply chamber (40). The excess fuel causes a receptacle (20) in the compartment to move downward. Through a retaining arm (82) and actuating arm (78), such movement communicates with a removable tank lift mechanism in response to the excess fuel condition. Also the mechanism prevents re-insertion of the removable tank (60) to its proper seating position until the danger of flareup is removed. This safety device also alerts the user of the liquid fuel burner to a dangerous condition by a mechanism comprising a highly visible warning gauge needle (34). In addition, the burner can be readily serviced and restored to operation should an excess fuel malfunction occur.

20 Claims, 3 Drawing Sheets

DEVICE FOR PREVENTING FLAREUP IN BAROMETRIC-TYPE WICK-FED LIQUID FUEL BURNERS

BACKGROUND

CROSS-REFERENCE TO RELATED APPLICATION

This invention is an improvement over the invention of an earlier application, Ser. No. 08/130,290, filed Oct. 4, 1993, now U.S. Pat. No. 5,338,185, granted Aug. 16, 1994, in the names of Richard W. Henderson and George R. Lightsey.

BACKGROUND

FIELD OF INVENTION

This invention relates to safety devices, specifically to a mechanism for prevention of flareup in barometric-type wick-fed liquid fuel burners.

BACKGROUND

DISCUSSION OF PRIOR ART

In wick-fed liquid fuel burners, such as kerosene heaters, liquid fuel from a fuel chamber is supplied to a wick which is exposed to the oxygen of the atmosphere. Once the wick has been ignited, flame intensity and heat generation are controlled by positioning the wick with respect to a wick receiving combustion chamber.

A common type of kerosene heater is the barometric style, in which fuel is delivered to a horizontal fuel chamber from a vertically-oriented removable tank inserted into the fuel chamber. The flow of fuel from the removable tank into the fuel chamber is governed by a barometric valve in the cap on the removable tank, which, in normal operation, maintains the level of the fuel in the fuel chamber at the level of the barometric valve. A partial vacuum above the fuel in the removable tank prevents the fuel from flowing into the fuel chamber until the fuel level in the fuel chamber drops below the barometric valve, which allows air to enter the removable tank. As air enters the removable tank through the barometric valve, fuel in the removable tank flows into the fuel chamber until the fuel level in the fuel chamber rises and covers the barometric valve in the removable tank cap, at which point fuel flow from the removable tank will cease. The barometric valve consists of a spring-loaded plunger, which has an enlarged head at one end. When the removable tank is inserted into the fuel chamber, the plunger head strikes a pin located in the fuel chamber, which pushes the plunger back, allowing the fuel in the removable tank to be in fluid communication with the fuel chamber. When the tank is removed, the action of the spring on the plunger head forces it against the opening in the tank cap, sealing the opening and preventing fuel from escaping from the tank.

Various improvements have been made to such burners which make them safer to operate. For example, tip-over shut-off mechanisms, manual shut-off devices, and low-level $O_2$ detectors have been employed. However, these burners continue to cause fires that result in death, injury, and property loss. The primary problem with such burners is that, under certain conditions, fuel can overflow the fuel chamber. When the flooded fuel ignites, the result is an uncontrolled fire, or flareup.

The most common reason For fuel overflow is the accidental use of fuels with high vapor pressures. Examples of such fuels are gasoline, naphtha, and inferior kerosene, which has a low flash point. In a barometric heater, overflow of fuel from the fuel chamber can occur if the partial vacuum in the removable tank is lost. As the temperature of the heater and its surroundings increases, the vapor pressure of the fuel in the removable tank increases and, under certain conditions, allows fuel to escape from the removable tank at a rate greater than the rate of burning of the fuel. The excess fuel eventually overflows the fuel chamber and spills onto the top of the fuel chamber and the surface supporting the heater. The spilled fuel can then ignite, causing an uncontrolled fire. A second way that the partial vacuum in the barometric heater's removable tank can be lost is by air entering through compromise of the integrity of the removable tank.

There are safety devices that drop the wick down, thereby extinguishing the flame, if the burner tips over or experiences excessive vibration, or if abnormal combustion is detected. Other safety devices detect high levels of $CO_2$ and low levels of $O_2$, and use these to control burning rates. Still others regulate the position of the wick during the ignition and extinguishing operations of the heater to prevent excessive flaming during these operations. Examples are shown in U.S. Pat. Nos. 4,363,620, issued Dec. 14, 1982 to Nakamura, 4,872,831, issued Oct. 10, 1989 to Fujimoto, 4,797,088, issued Jan. 10, 1989 to Nakamura, and 5,165,883, issued Nov. 24, 1992 to Van Bemmel. In some cases, the safety devices require the use of electrical power and electronic circuitry for actuation.

It has been suggested in two publications ("Kerosene Heater Fires: Barometric Type," R. Henderson et al., *Fire Marshals Bulletin* (*National Fire Protection Association*), Vol. 87-5, p. 8 (1987); "*Barometric Kerosene Heaters*," R. Henderson, *Fire and Arson Investigator* (International Association of Arson Investigators), Vol. 39, No. 3, p. 26 (1989)) to make the size of the removable tank of barometric kerosene heaters comparable in volume to that of the fuel chamber so that flooding of the fuel chamber will not occur. To implement this suggestion, either the capacity of the removable tank must be reduced, or alternatively, that of the fuel chamber must be increased. However, reducing the capacity of the removable tank will reduce the burn time accordingly, and possibly affect the marketability of the heaters. Increasing the capacity of the fuel chamber will require that new tanks be designed and implemented.

Also, it has been suggested that a float device be introduced into the fuel chamber to be used to activate the automatic wick extinguishing mechanism, and a sight gauge be present to show dangerous fuel levels in the fuel chamber. Introduction of such a float device would also require that the fuel chamber be redesigned, as discussed above. Although some burners have sight gauges in the fuel chamber, the sight gauges are used only to indicate whether or not fuel is present, and not when dangerous fuel level s are present in the fuel chamber.

In addition it was proposed that a tank block-out device be installed, in which a float in the reservoir would push on a pin that could move should the removable tank be withdrawn from the heater. Once again, such a device would require a redesigning of the fuel chamber and insertion of moving parts inside a somewhat restricted space. Also, this type of device would not prevent the entire contents of the removable tank from flowing into the fuel chamber, since it becomes operable only after the removable tank has been withdrawn.

U.S. Pat. No. 5,080,578, issued Jan. 14, 1992 to Josephs, claims that its device controls flareup in wick-fed liquid fuel burners by a) cutting off the flow of fuel to the wick in response to excessive heat by blocking a Fuel line, and b) withdrawing the wick into the wick chamber when sensing excessive heat. However, this device has several disadvantages:

a) Excessive heat must be generated near the sensors before the flow of fuel is interrupted, or the wick is withdrawn. Therefore, since flareup is not prevented, the device only limits the spread of excessive flames after flareup has already occurred.

b) Excessive heat sensing devices must be near the area where uncontrolled burning is taking place due to overflow of fuel. Often the path that the overflowing fuel takes is random and flareup may not initially occur near the heat sensors.

c) The device is not applicable to barometric liquid fuel burners—the most common wick-fed liquid fuel burners in use—because these burners do not have fuel lines.

d) From the onset of flareup in wick-fed liquid fuel burners, fire is present outside the wick, and therefore retracting the wick does not affect the flareup process.

The device of the above-referenced related patent application of Henderson and Lightsey prevents flareup by activating a wick extinguishing mechanism when the presence of excess fuel i s detected in the fuel chamber. While this device has much merit, it should be noted that to be effective it requires activation of a second entity, the automatic wick extinguishing mechanism; should that mechanism fail to respond, due to tar buildup on the wick or a mechanical problem, flareup can still occur.

OBJECTS AND ADVANTAGES

Accordingly, one object and advantage of the present invention is to provide wick-fed, barometric liquid fuel burners with a safety device which prevents fuel overflow from the fuel chamber, and therefore, prevents flareup. Other objects and advantages are to provide such a burner which does not require the reduction in capacity of the removable fuel increase in tank, does not require an the capacity of the fuel chamber, does not require the redesigning of the fuel chamber to accommodate a float device, does not require electrical power or electronic circuitry, does not require the presence of excessive heat for its actuation, and is applicable to kerosene heaters that do not have fuel lines.

In addition, the present burner does not have any substantially increased weight, does not rely on activating an automatic wick extinguishing mechanism for its effectiveness in preventing flareup, will provide a warning device to alert consumers of the dangerous condition in the liquid fuel burner, is easily serviced should excess fuel enter the fuel chamber, will save lives and property, will make barometric liquid fuel burners easier to market because of added safety value, and will likely reduce the number of expensive lawsuits prompted by injury, loss of life, and property damage. Still further objects and advantages will become apparent from a consideration of the ensuing description and drawings.

DRAWING REFERENCE NUMERALS

Figure 1:
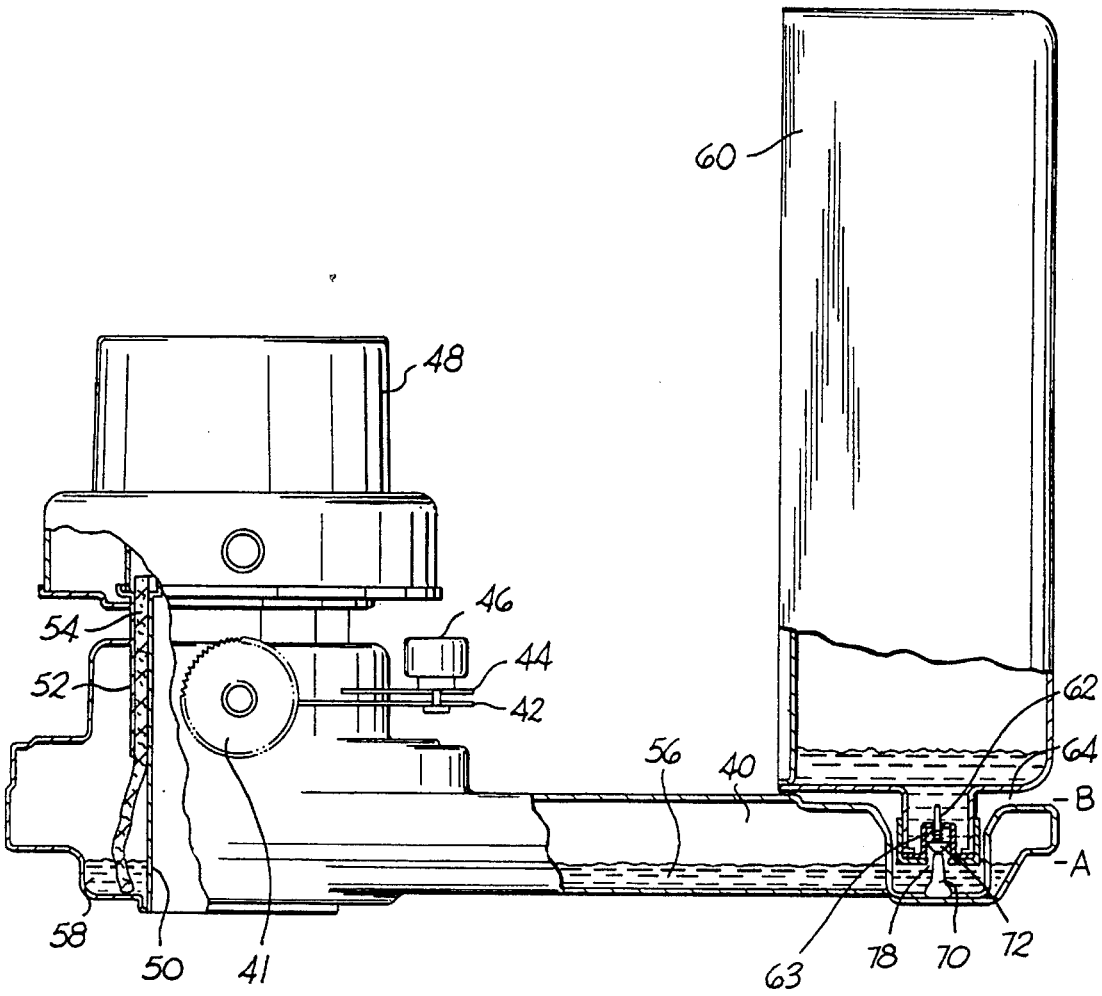
PRIOR ART FIG. 1
FIG. 1 is a side sectional view of a prior-art, conventional wick-fed, barometric liquid fuel burner with a vibration-sensing weight that activates an automatic wick extinguishing unit.

10 Cap 12 Eductor tube 14 Float 16 Pivot point 18 Balance arm 20 Receptacle 22 Attached at 24 Excess fuel containment compartment 26 Port 28 Rod guide 30 Rod 32 Attached at 34 Warning gauge needle 36 Pivot point 38 Operating lever 40 Fuel chamber 41 Wick gear 42 Automatic wick extinguishing unit 44 Frame member 46 Vibration-sensing weight 48 Combustion cylinder 50 Inner wick guide 52 Outer wick guide 54 Wick 56 Fuel 58 Wick fuel supply reservoir 60 Removable fuel tank 61 Tank cap 62 Plunger 63 Plunger spring 64 Opening 66 Actuating rod face 68 Sleeve 70 Pin 72 Plunger head 74 Catch arm 76 Actuating rod 78 Orifice 80 Attached at 82 Retaining arm 84 Spring 86 Attached at A Normal fuel level B Flooded fuel level

SUMMARY

In accordance with the present invention, an anti-flareup safety device for wick-fed, barometric liquid fuel burners effectively detects the presence of excess fuel in the fuel chamber and lifts the removable tank so that the barometric valve closes, thereby shutting off the fuel flow into the Fuel chamber. Upon activation, the device deflects a warning gauge needle to warn of a dangerous condition, prevents introduction of fuel from the removable tank into the fuel chamber via the barometric valve, results in extinguishment of the wick flame once the fuel in the fuel chamber is consumed, and enables the burner to be easily serviced should excess fuel actuate the safety device.

The safety device includes an excess fuel containment compartment to receive and hold excess fuel, a receptacle which is located inside the excess fuel containment compartment and which receives excess fuel from the fuel chamber, and which moves downward in response to the added weight of the excess fuel, a float which maintains the downward position of the receptacle should the receptacle overflow, a rod which is pulled downward by the movement of the receptacle, an operating lever which moves downward with the rod, a warning gauge needle which deflects in response to the movement of the operating lever, a retaining arm which prevents movement of the actuating rod until the receptacle moves downward in response to the weight of fuel, a spring-loaded actuating rod which moves upward when the retaining arm moves clear of the end of the catch arm of the actuating rod, an actuating rod which moves upward due to spring action, the movement of which actuating rod causes the actuating rod face to contact the base of the removable fuel tank, forcing it upward, which results in the downward movement of the plunger by spring action until the plunger head closes off the orifice in the removable tank cap, thereby shutting off the flow of fuel into the fuel chamber from the removable tank.

DESCRIPTION

CONVENTIONAL HEATER STRUCTURE—FIG. 1

FIG. 1 is a side sectional view of a conventional wick-fed, barometric liquid fuel burner that operates by burning a liquid fuel, such as kerosene. The burner is a wick-fed type with combustion cylinder 48 and is constructed in a manner widely known in the art.

In normal operation fuel is delivered from a removable fuel tank 60 to a horizontal fuel chamber 40 through an orifice in a tank cap 61 on tank 60. Tank 60 is held in a vertical position by guides in a cabinet (not shown) in the common practice of the industry. Cap 61, which is attached to the neck of tank 60, is inserted into a mating well in the top surface of chamber 40, also the common practice in the industry.

When the fuel level in chamber 40 drops below level A due to fuel consumption by wick 54, air will bubble into tank 60 through orifice 78 in tank cap 61 and fuel (e.g., kerosene) will flow into tank 60 flow from tank 60 into chamber 40 until the level in chamber 40 reaches level A. A partial vacuum above the fuel in tank 60 maintains the fuel in tank 60 above level A until all of the fuel has been discharged from tank 60. Fuel 56, which is in fluid communication with wick 54, migrates by capillary action up wick 54 and is burned inside combustion cylinder 48, which generally consists of inner metal cylinders and an outer glass cylinder. Cylinder 48 provides a surface for the burning of the fuel, and radiates heat and some light. The flame is not shown but is seen as red glow in cylinder 48, above the wick.

Wick 54, cylindrical in shape and shown in a partial cross-sectional view, can be moved up or down by rotating a wick gear 41. Wick 54, wick guides 50 and 52, combustion cylinder 48, wick fuel supply reservoir 58, and vibration-sensing weight 46 in FIG. 1 are circular in shape when seen from above, whereas compartment 40 is generally rectangular. Removable fuel tank 60 is most commonly rectangular in shape as viewed from above, but various other shapes are also found, such as triangular. Tank cap 61 is cylindrical in shape, and is threaded to allow attachment to tank 60.

The fuel burner has an automatic wick extinguishing unit 42, which includes a vibration-sensing weight 46. If the burner is tilted or vibrated excessively, unit 42 disengages wick gear 41, which lowers wick 54, extinguishing the flame, or actuates other wick extinguishing mechanism (not shown).

This burner, with its automatic wick extinguishing unit, is widely known in the art. Manufacturers include Toyotomi Kogyo Co., Ltd., and Hitachi Heating Appliances Co., Ltd., both of Japan.

OPERATION AND DANGER OF FLAREUP WITH CONVENTIONAL BURNER—FIG. 1

If the partial vacuum in tank 60 is lost due to introduction of high vapor pressure fuels, such as gasoline or inferior kerosene, or if the integrity of tank 60 is compromised, the barometric system as described earlier, no longer regulates fuel flow from tank 60. As a result, excessive fuel will flow into chamber 40. Since the capacity of tank 60 is considerably greater than that of chamber 40, chamber 40 will not be able to contain all of the fuel from tank 60, if any significant amount of fuel is present in tank 60. As a result, chamber 40 fills with fuel and overflows out opening 64 between tank 60 and the housing of chamber 40. The rue 1 spreads over the fuel chamber's surface and to other areas in the burner. The flooded fuel will ignite because the vapors from the leaked fuel are drawn by air movement toward the wick flame (not shown) in chamber 48, which is of sufficient temperature to ignite these fumes. As a result there will be flames in and around tank 60, causing the pressure inside tank 60 to increase drastically, driving more fuel out of tank 60, further increasing the amount of escaped fuel, and accordingly increasing the severity of the flareup.

With the exception of the Henderson and Lightsey device, prior-art safety devices do not prevent flareup, but rather detect evidence that flareup has begun. Most of these devices will trigger an automatic wick extinguishing unit (not shown), which acts to extinguish the flame on the wick. However, by the time flareup has begun, there are flames outside the wick area and extinguishment of the wick flame does not affect the progression of flareup. The flames are present where fuel has flooded, and the increasing amounts of fuel being discharged from the removable tank further increase the magnitude of the flareup incident, as described earlier. The Henderson and Lightsey device is designed to extinguish the flame on the wick prior to flareup. However, if the wick-drop mechanism fails to operate when activated as a result of the wick becoming encrusted, or if there is some other problem with the wick shut-off mechanism, this device will not be able to prevent flareup.

Thus, prior-art safety devices, such as those which monitor excessive vibration of the burner, detect high levels of $CO_2$ and low levels of $O_2$, detect abnormal combustion, and regulate the position of the wick to prevent excessive flaming, are ineffective in preventing flareup. The safety device described in the Josephs patent, supra, does not prevent flareup, but rather provides a wick drop mechanism, and cuts off fuel flow through a fuel line after the onset of flareup. Since the wick-fed barometric liquid fuel burners in common use do not utilize a fuel line, Josephs' device is not applicable to them.

DESCRIPTION OF INVENTIVE ANTI-FLAREUP DEVICE—FIG. 2

Figure 2:
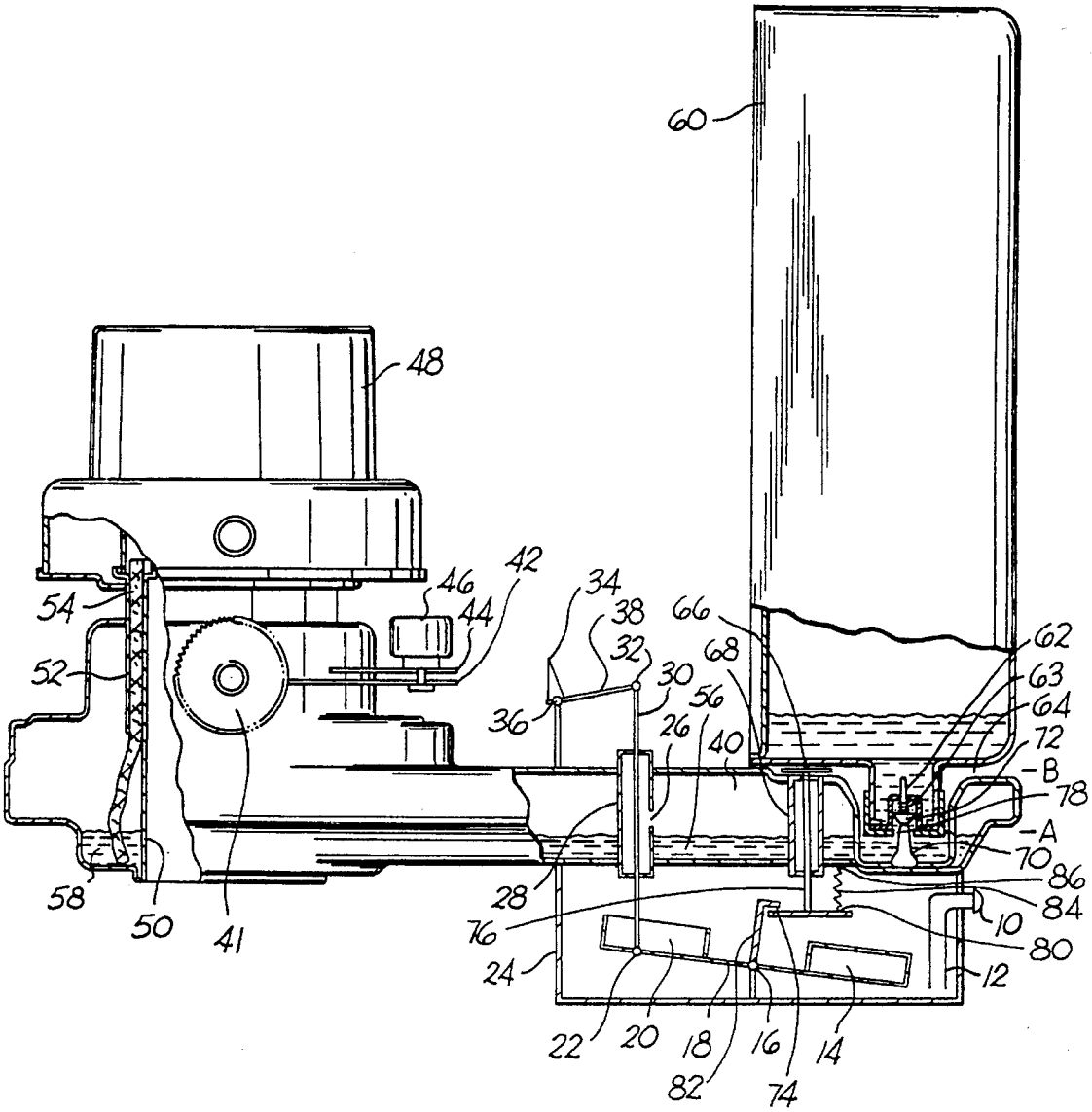
FIG. 2 is a side sectional view of a wick-fed, barometric liquid fuel burner showing the operating mechanism of the anti-flareup safety device in accordance with the preferred embodiment of the present invention.
Figure 3:
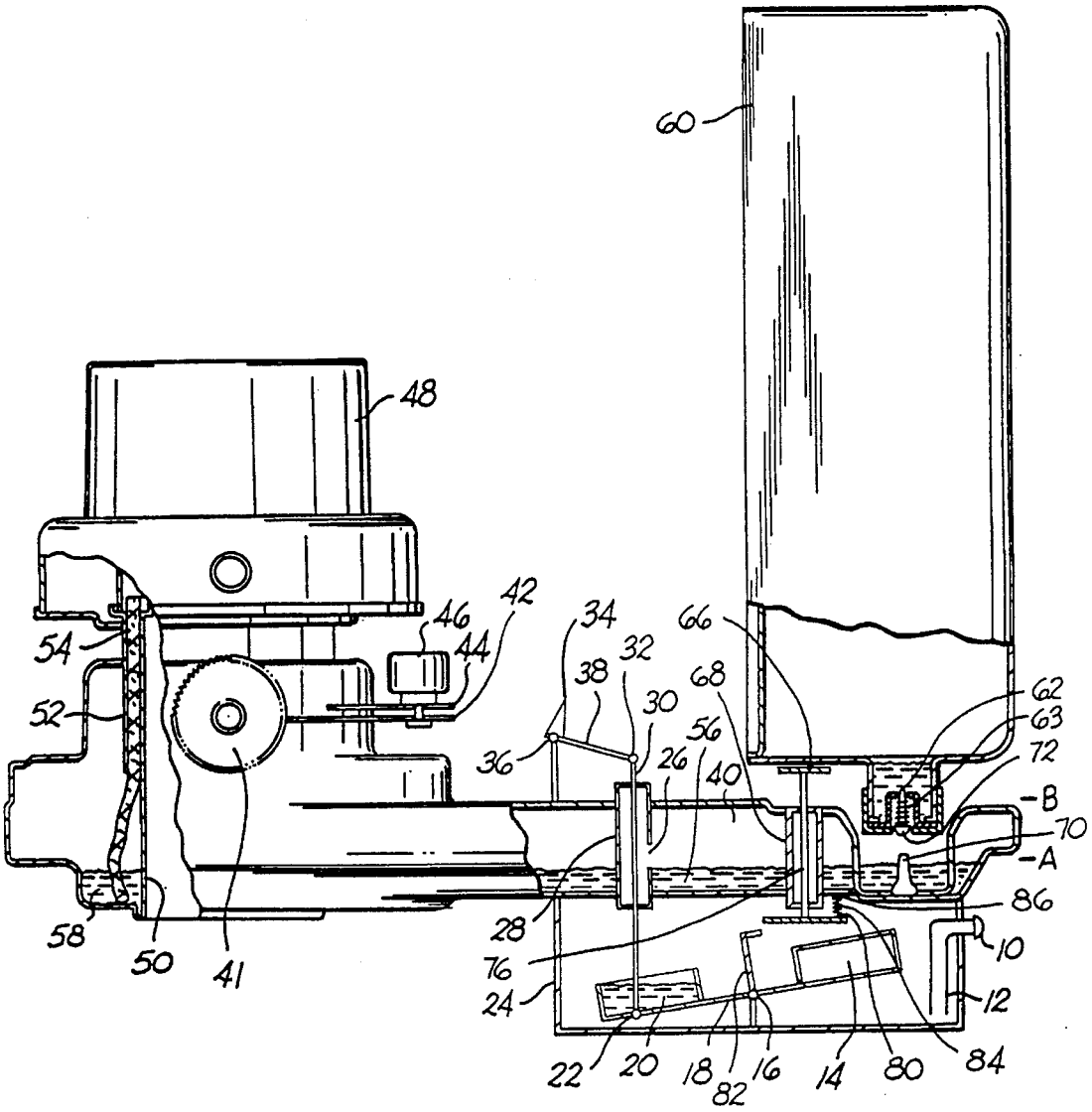
FIG. 3 is a side sectional view of a wick-fed, barometric liquid fuel burner showing the operating mechanism of the anti-flareup safety device in accordance with the preferred embodiment of the present invention after the operating mechanism has been activated by a dangerous fuel condition in the burner.

These problems are solved by the wick-fed, barometric liquid fuel burner of FIG. 2. It includes the following conventional elements: a removable tank 60 with a tank cap 61 having an orifice 78 and housing a spring-loaded plunger 62, a fuel chamber 40, a wick 54, a combustion cylinder 48, a vibration-sensing weight 46, and an automatic wick extinguishing unit 42.

In addition, the burner of FIG. 2 includes additional elements which constitute a preferred embodiment of the present inventive anti-flareup safety device. An excess fuel containment compartment 24 is located below the level of fuel chamber 40. Inside compartment 24 is found an eductor tube 12 sealed by a cap 10. Also, in compartment 24, a float 14 is attached to a balance arm 18, which moves about a pivot point 16, which is secured to a convenient frame member, such as the bottom of compartment 24. A retaining arm 82, which is attached to arm 18, has a vertical portion extending upwardly from arm 18 and then a horizontal portion at its upper end. The horizontal portion is in contact with and restrains catch arm 74, which at its distal end is under an upward tension from a spring 84. Arm 74 is attached to an actuating rod 76, which passes through chamber 40 inside a sleeve 68. An actuating rod face 66, which is at the topmost end of rod 76 is positioned just below tank 60.

A receptacle 20 is attached to balance arm 18 at the end opposite float 14. A rod 30 is attached at its lower end at attachment point 22 to receptacle 20. Rod 30 passes through chamber 40 inside a rod guide 28, which has a port 26 incorporated into the cylindrical rod guide wall inside chamber 40. The uppermost end of rod 30 is attached at point 32 in a pivoting fashion to an operating lever 38, which is attached at a pivot point 36, which is in turn secured to a convenient frame member, such as the top of chamber 40. A warning gauge needle 34 is situated on lever 38.

When viewed from above, compartment 24 preferably has the shape of chamber 40, which is rectangular, but may have other shapes. The dimensions of compartment 24 are approximately 15 cm (6 inches) wide by 18 cm (7 inches) long by 5 cm (2 inches) deep. Compartment 24 fits between the bottom surface of chamber 40 and a horizontal base tray (not shown) which supports the liquid fuel burner in the typical fashion of the industry. The bottom surface of compartment 24 is flat and is in contact with the top surface of the basetray.

Receptacle 20 is a container which is open at its top, and which is preferably square or rectangular, but may be of any shape that will fit conveniently and easily inside compartment 24, provided that its walls and bottom are joined in a liquid-tight manner.

Float 14 preferably is square or rectangular, but may be of any shape that will conveniently and easily fit inside compartment 24.

Receptacle 20 and float 14 are each approximately 6 cm (2.5 inches) wide by 8 cm (3 inches) long by 3 cm (1 inch) deep, but may be cylindrical or other convenient shape so long as the capacity of each is about 140 to 160 cu cm (5 to 8 cubic inches), since the amount of excess fuel that will activate the safety device is approximately 100 to 140 cu cm (3 to 5 cubic inches).

Balance arm 18 is of a size and shape that will fit into compartment 24 and provide support for receptacle 20 and float 14, and is preferably of rectangular shape, with its length being such that arm 18 does not touch either end of compartment 24, or eductor tube 12.

Rods 30 and 76 may be cylindrical or another convenient shape that will move freely and vertically inside guide 28 and sleeve 68, respectively, and are about 5 to 10 cm (2 to 4 inches) long. Rod guide 28 and sleeve 68 are long enough to reach from the top surface to the bottom surface of chamber 40, and are approximately 2 to 5 cm (1 to 2 inches) long. Port 26 is about 0.5 to 1 cm (0.25 to 0.5 inch) in diameter. Lever 38 is of a convenient shape, such as flat, so long as it is appropriate for connection to rod 30. Arms 74 and 82 are about 2 cm (1 inch) long overall, and of a convenient shape, such as flat. Spring 84 is of sufficient size and shape such that, when distended, it has sufficient strength to force tank 60 upward even when tank 60 is filled with fuel. When so filled, tank 60 has a combined tank/fuel weight of approximately 4.5 kg (10 pounds). The upward movement of rod 76 necessary to move tank 60 sufficiently to allow plunger head 72 to close off orifice 78 is about 1 cm (0.5 inch).

The sizes and weights of the components may be varied somewhat, so long as the net effect, including any spring tension or other mechanism, is to maintain receptacle 20 in its uppermost position, but such that amounts of liquid fuel on the order of 100 cu cm (several cubic inches) will cause receptacle 20 to move downward.

OPERATION OF INVENTIVE ANTI-FLAREUP DEVICE—FIG. 2 AND FIG. 3

During normal operation, the fuel level in chamber 40 remains at or below level A. Receptacle 20 normally stays in its most upward position as shown. It is held there by the marginally greater weight of float 14 acting through pivot point 16, by spring tension, or by other appropriate mechanisms.

If excess fuel is delivered to chamber 40, due to high vapor pressure fuel, loss of vacuum in tank 60, or any other cause, the excess fuel will flow into port 26 in rod guide 28, down guide 28, and into receptacle 20. Receptacle 20 maintains its upward position until sufficient excess fuel overflows into it via guide 28.

When the weight of the excess fuel in receptacle 20 offsets the greater weight of float 14 and other components, receptacle 20 will move downward, pulling vertical rod 30 down. This will move operating lever 38 about pivot point 36, causing warning gauge needle 34 to deflect. Needle 34 is attached to lever 38 at pivot point 36. Needle 34 is used to indicate the change in status of the burner to a dangerous condition.

The downward movement of receptacle 20 will al so cause arm 18 to rotate, causing arm 82 to rotate as well. The gear of arm 82 will move to the left, releasing arm 74, which thereupon will be pulled upward due to the tension provided by spring 84. As arm 74 moves upward, it pushes rod 76 upward, which forces tank 60 upward. As tank 60 move s upward, spring tension on plunger head 72 forces head 72 downward, until it closes orifice 78, thereby preventing fuel flow from tank 60 to chamber 40 through orifice 78 in cap 61. Tank 60 is guided in its upward movement by the same cabinet guides that constrain the tank during its insertion into the cabinet for normal operation.

If excess fuel continues to flow into receptacle 20, causing the fuel in receptacle 20 to overflow into the bottom of compartment 24, float 14 will experience an upward force, continuing the downward force on rod 30 through pivot point 16. This keeps warning gauge needle 34 deflected. After the fuel in fuel chamber 40 has been consumed by the flame on the wick, no additional fuel will be supplied to chamber 40 from tank 60. This is due to the fact that tank 60 is prevented from seating in chamber 40. Thus pin 70 will not be able to push plunger head 72 back sufficiently to open orifice 78.

For the burner to be restored to normal operation, the fuel in compartment 24 must be removed. This can be accomplished by applying suction to the portion of eductor tube 12 outside compartment 24 after removal of cap 10. Receptacle 20 is emptied by laying the burner on its side and allowing the fuel to run into compartment 24, after which the Fuel is removed via tube 12. This removal of fuel will allow arm 18 with receptacle 20 and float 14 to rotate clockwise, back to its normal orientation, with receptacle 20 in its upward position. Arm 82 and its gear portion will concomitantly move back to the original locking pattern. After compartment 24 has been cleared of fuel, as described above, the tank lift mechanism can be reset by depressing tank 60 until arm 74 snaps past the gear of arm 82, whereupon the gear will hold arm 74 in the down position.

ADVANTAGES

It is clear from a consideration of the discussion above that the anti-flareup safety device is quite simple in construction and can be easily retrofited to present wick-fed, barometric liquid fuel burners. Yet it will prevent flareup by providing an excess fuel containment system, and by quickly shutting off the fuel supply before fuel can leak outside the containment systems and the leaked fuel can ignite. After the safety device is activated, the fuel in the fuel chamber will continue to be consumed until it is depleted.

In addition, the device includes a highly visible warning gauge needle to indicate danger from the presence of excess fuel in the fuel chamber, thereby alerting the user to the dangerous condition of the burner.

The present device will shut down the liquid fuel burner prior to ignition and burning of fuel outside its intended site, that being at the wick, thereby saving fuel and reducing odor. Also, the device does not require any electrical power or electronic circuitry, being activated by the presence of excess fuel. Also, activation of the safety device mechanisms by the presence of excess fuel in the fuel chamber will cause the warning gauge needle to be deflected to indicate the presence of a dangerous condition. Additionally, should excess fuel activate the safety device mechanisms, the excess fuel can be easily removed from the excess fuel containment compartment, so that the burner can be serviced and put back in operation without undue difficulty.

Clearly, the device incorporates multiple safety features, which will make wick-fed, barometric liquid fuel burners safer to operate, and accordingly, will at the same time reduce the expensive lawsuits resulting from flareup incidents causing injury, loss of life, and property damage. As a result these burners will be easier to market.

RAMIFICATIONS AND SCOPE

Those skilled in the art can now appreciate from the foregoing description that the broad teachings of the present invention can be implemented in a variety of forms. Therefore, while the safety device has been described in connection with particular examples thereof, the true scope of the invention should not be so limited since other modifications will become apparent to the skilled practitioner upon a study of the drawings, specification and following claims.

For example, the shapes and composition of the various parts of the safety device can be varied greatly, so long as their function is preserved. Thus, while the rod and rod guide are depicted as being cylindrical, clearly they can have other shapes, such as oval, square, rectangular, etc. A1 so, the port for excess fuel flow from the fuel chamber into the excess fuel containment compartment does not necessarily have to be located in the rod guide, but may be located elsewhere in the bottom of the fuel chamber, and the port can be consist of several openings rather than just one as depicted.

The receptacle/float combination can be changed to just float mechanism or just a receptacle mechanism for activation of the safety device; if just a receptacle is utilized, a shock absorber could be incorporated to help prevent nuisance activation. The excess fuel containment compartment is described as being square or rectangular when viewed from the top, but it may be oval, circular, etc. The dimensions of the excess fuel containment compartment are governed by the size of the space available under the fuel chamber. The fuel containment compartment may be alternatively located beside the fuel chamber, rather than directly below it as depicted in the drawings, so long as the compartment is below the level of the fuel chamber. The warning gauge needle may be eliminated, as may be the eductor tube. Although the receptacle and float are described as being square or rectangular when viewed from above, they may have other shapes, such as circular, triangular, etc. While the preferred composition of the various parts of the safety device is metal, other material s may also be utilized, such as plastics, composites, etc. Also, the device may be connected to the automatic wick extinguishing unit.

Thus the scope of the invention should be determined, not by the examples given, but by the appended claims and their legal equivalents.

What is claimed is:

1. An apparatus for preventing flareup in a liquid fuel burner of the type comprising a removable liquid fuel tank having a shutoff valve which closes when said tank is removed from a fuel chamber and which opens when said tank is attached to said chamber, a fuel chamber, and a combustion chamber having a wick, where said fuel chamber carries liquid fuel from said removable tank to said wick of said combustion chamber, comprising:

excess fuel containment means for receiving or holding excess fuel from said fuel chamber if the amount of fuel in said fuel chamber exceeds a predetermined level; and lifting means for lifting said removable tank and thereby closing its shutoff valve in response to said fuel in said fuel chamber exceeding said predetermined level, whereby the movement of said fuel from said removable tank into said fuel chamber is prevented when the fuel level in said fuel chamber exceeds said predetermined level.

2. An apparatus according to claim 1 wherein said excess fuel containment means comprises an excess fuel containment compartment and said removable tank lifting means s responsive to the presence of said excess fuel in said excess fuel containment compartment.

3. An apparatus according to claim 1, further including means for preventing re-insertion of said removable tank to its proper seating position if said tank was moved upward due to the presence of said excess fuel in said excess fuel containment compartment.

4. An apparatus according to claim 1 wherein said excess fuel containment means comprises an excess fuel containment compartment and said removable tank lifting means is responsive to the presence of fuel in said excess fuel containment compartment, and further including means for preventing re-insertion of said removable tank to its proper seating position if said removable tank was displaced from its normal seating position due to the presence of said excess fuel in said fuel chamber.

5. An apparatus according to claim 1, further including means for providing a visual danger indication to alert the user of the dangerous condition of said excess fuel in an excess fuel containment compartment.

6. An apparatus according to claim 1, further including (a) means for providing a visual danger indication to alert the user of the dangerous condition of said excess fuel in an excess fuel containment compartment, and (b) means for preventing reinsertion of said removable tank to its proper seating position if said removable tank was displaced from its normal seating position due to the presence of said excess fuel in said fuel chamber.

7. An apparatus according to claim 1, further including directing means for directing the flow of said excess fuel into said excess fuel containment means, said directing means comprising a rod guide which connects said fuel chamber to said excess fuel containment compartment, said rod guide having a port therein.

8. An apparatus according to claim 1 wherein said excess fuel containment means comprises an excess fuel containment compartment, and further including means for directing said excess fuel in said fuel chamber into said excess fuel containment compartment, said excess fuel containment compartment containing a receptacle, said receptacle being arranged to move downward in response to said excess fuel, said receptacle being connected to a retaining arm so that downward movement of said receptacle will move said retaining arm, said retaining arm holding an actuating arm, such that said actuating arm when released by said retaining arm, will activate said removable tank lift means.

9. An apparatus according to claim 1 wherein said excess fuel containment means comprises an excess fuel containment compartment, and further including means for removing said excess fuel from said excess fuel containment compartment, whereby said apparatus can be reset so that the liquid fuel burner can be restored to operation.

10. An apparatus according to claim 1 wherein said excess fuel containment means comprises an excess fuel containment compartment, and further including means for directing said excess fuel from said fuel chamber into said excess fuel containment compartment, said excess fuel containment compartment containing float device situated on a balance arm, so that said excess fuel in said excess fuel containment compartment causes said float device to be urged upward, in turn causing a distal end from said float device of said balance arm to move downward, said balance arm being connected to a retaining arm so that downward movement of said balance arm will move said retaining arm, said retaining arm holding an actuating arm, such that said actuating arm when released by said retaining arm, will activate said removable tank lift means.

11. An apparatus for preventing flare-up in a liquid fuel burner of the type comprising a liquid fuel removable tank, a fuel chamber, an automatic wick extinguishing means, and a combustion chamber having a wick, where said fuel chamber carries liquid fuel from said removable tank to said wick of said combustion chamber, comprising:

excess fuel containment means for receiving or holding fuel in which excess fuel is directed into an excess fuel containment compartment from said fuel chamber if the amount of fuel in said fuel chamber exceeds a predetermined level;

removable tank lift means for lifting said removable tank sufficiently to shut off fuel flow through the barometric valve should said fuel in said fuel chamber exceed said predetermined level; and means for removing said excess fuel from said excess fuel containment means.

12. An apparatus according to claim 11, further including means for directing the flow of said excess fuel into said excess fuel containment means, said directing means comprising a rod guide which connects said fuel chamber to said excess fuel containment compartment, said rod guide having a port therein.

13. An apparatus according to claim 11, further including means for providing a visual danger indication to alert the user of a dangerous condition when said excess fuel is in said excess fuel containment compartment.

14. An apparatus according to claim 11, further including means for directing the flow of said excess fuel into said excess fuel containment means, said directing means comprising a rod guide which connects said fuel chamber to said excess fuel containment compartment, said rod guide having a port therein.

15. An apparatus according to claim 11, further including (a) means For providing a visual danger indication to alert the user of the dangerous condition of said excess fuel in said excess fuel containment compartment, and (b) directing means for directing the flow of said excess fuel into said excess fuel containment means, said directing means comprising a rod guide which connects said fuel chamber to said excess fuel containment compartment, said rod guide having a port therein.

16. An apparatus according to claim 11 wherein said excess fuel containment means comprises an excess fuel containment compartment, and further including means for directing said excess fuel in said fuel chamber into said excess fuel containment compartment, said excess fuel containment compartment containing a receptacle, said receptacle being arranged to move downward in response to said excess fuel, said receptacle being connected to a rod so that downward movement of said receptacle will pull said rod downward, said rod being connected to an operating lever, said operating lever being connected to said automatic wick extinguishing means.

17. An apparatus according to claim 11, further including means for directing said excess fuel from said fuel chamber into said excess fuel containment compartment, said excess fuel containment compartment containing a float device situated on a balance arm, so that said excess fuel in said excess fuel containment compartment causes said float device to be urged upward, in turn causing a distal end from said float device of said balance arm to move downward, said balance arm being connected to a retaining arm so that downward movement of said balance arm will move said retaining arm, said retaining arm holding an actuating arm, such that said actuating arm when released by said retaining arm will activate said removable tank lift means.

18. A method of preventing flare-up in a liquid fuel burner of the type comprising a liquid fuel removable tank, a fuel chamber, and a combustion chamber having a wick, where said fuel chamber carries liquid fuel from said removable tank to said wick of said combustion chamber, comprising the steps of:

containing excess fuel in said fuel chamber by directing excess fuel which exceeds a predetermined level in said rue 1 chamber into an excess fuel containment compartment;

directing the flow of said excess fuel in said excess fuel containment compartment into a receptacle in said excess fuel containment compartment; and lifting said removable tank in response to said flow of said excess fuel into said receptacle.

19. The method of claim 18 wherein said removable tank is lifted by causing said receptacle to move downward in response to the weight of said excess fuel.

20. The method of claim 19 wherein said removable tank is lifted in response to downward movement of said receptacle.

* * * * *